US005265919A

United States Patent [19]

Takemoto et al.

[11] Patent Number: 5,265,919

[45] Date of Patent: Nov. 30, 1993

[54] PIPE JOINT MADE OF STAINLESS STEEL AND METHOD OF MAKING THE SAME

[75] Inventors: Toshihiko Takemoto, Tokuyama; Masayuki Kinugasa, Hiroshima; Teruo Tanaka, Kure; Takashi Igawa, Yamaguchi, all of Japan

[73] Assignee: Nisshin Steel Co., Ltd., Tokyo, Japan

[21] Appl. No.: 778,820

[22] PCT Filed: Jun. 22, 1990

[86] PCT No.: PCT/JP90/00816

§ 371 Date: Dec. 24, 1991

§ 102(e) Date: Dec. 24, 1991

[87] PCT Pub. No.: WO91/00372

PCT Pub. Date: Jan. 10, 1991

[30] Foreign Application Priority Data

Jun. 26, 1989 [JP] Japan ..... 1-163130

[51] Int. Cl.[5] ..... F16L 19/08

[52] U.S. Cl. ..... 285/381; 285/422; 29/447; 148/325; 148/563

[58] Field of Search ..... 285/381, 422; 148/325, 148/423, 424, 563, 605; 29/447

[56] References Cited

U.S. PATENT DOCUMENTS 3,579,805 5/1971 Kast ..... 285/381 X 4,019,925 4/1977 Nenno et al. ..... 148/563 X 4,455,041 6/1984 Martin ..... 285/381 X 4,872,713 10/1989 Kapgan ..... 285/381

4,951,978 8/1990 Martin ..... 285/381 X

*Primary Examiner*—Dave W. Arola

*Attorney, Agent, or Firm*—Lowe, Price, LeBlanc & Becker

[57] ABSTRACT

In order to provide a pipe joint of stainless steel including more than 10% of Cr which joint has excellent shape memory effect, the stainless steel comprises up to 0.10% of C, 3.0 to 6.0% of Si, 6.0 to 25.0% of Mn, up to 7.0% of Ni, more than 10.0 to 17.0% of Cr, 0.02 to 0.30% of N, 2.0 to 10.0% of Co, and optionally one or more selected from 0.05 to 0.8% of Nb, 0.05 to 0.8% of V, 0.05 to 0.8% of Zr, 0.05 to 0.8% of Ti, up to 2.0% of Mo and up to 2.0% of Cu and the alloying components are balanced so that no δ-ferritic phase may substantially appear in the annealed condition. Since the joint is treated so that it has such a shape memory effect that it will recover the memorized original shape with a smaller diameter when heated to an appropriate temperature, it can fasten a pipe or pipes merely by heating. Furthermore, the joint is galvanized on its surface so as to improve sealability in fastening the pipe(s) and to suppress crevice corrosion from occurring at the interface between the joint and pipe(s).

6 Claims, No Drawings

PIPE JOINT MADE OF STAINLESS STEEL AND METHOD OF MAKING THE SAME

FIELD OF THE INVENTION

The present invention relates to a pipe joint of stainless steel which can provide tight junction based on its shape memory effect and which is excellent in crevice corrosion resistance in joining areas thereof.

BACKGROUND OF THE INVENTION

There have been used a various kind of pipe joints such as flange joints, screw type pipe joints and butt weld type pipe joints. In applications where corrosion resistance is of paramount importance, pipe joints made of stainless steel have been used. When these pipe joints are used to connect pipes, they generally need a connecting process such as mechanical fastening of welding and an accuracy of the connecting process directly affects whether leakage occurs or not. Therefore, not only it is important to perform discreetly the process but also the working by itself is complicate and requires well trained workers. When the working is conducted to an existing pipe arrangement, the working such as mechanical fastening or welding may be impossible because of a possibly narrow working space depending upon the particular place where connection of pipes is required.

Also proposed are some pipe joints made of shape memory alloys such as Ni-Ti alloys and Cu alloys. These pipe joints are to make use of shape recovery function by change in temperature of shape memory alloys to connect pipes. More specifically, a pipe joint is prepared from a shape memory alloy with an inner diameter at the pipe ends smaller than an outer diameter of pipes to be connected; and this shape of the joint is memorized; then at a low temperature the inner diameter of the joint is deformed to be larger than the outer diameter of the pipes to be connected; in this state the pipes are inserted into the joint with slight clearance between the pipes and joint; and then the memorized shape of the joint with the smaller diameter prior to the deformation is recovered by heating the connected areas to a proper temperature to fasten the pipes. In this case, since the tight junction can be obtained only by heating of the connected areas, the connecting workability is excellent. Accordingly, if such a joint is generalized, it seems that it extremely contributes to the art.

As shape memory alloys, there are known not only some nonferrous metal alloys including the above-mentioned Ni-Ti alloys and Cu alloys but also some ferrous metal alloys such as Fe-Pd alloys, Fe-Ni alloys and Fe-Mn alloys. Among others, Ni-Ti alloys have been actually used in the manufacture of pipe joints, since they are excellent in shape memory effect and mechanical properties. However, Ni-Ti alloys are very expensive. Furthermore, in the case of a pipe joint of a Ni-Ti alloy, after it is finished so as to have pipe ends with an inner diameter smaller than an outer diameter of pipes to be connected, the ends of the joint must be expanded to a diameter larger than the outer diameter of the pipes to be connected at a low temperature and while keeping that low temperature the pipes must be inserted into the joint from both ends thereof. Thus, the connecting process with this joint requires the low temperature and, therefore this joint is disadvantageous because of low workability of the connecting process.

On the other hand, "YOSETU GIJUTU (welding technic), September 1988, pp. 78~84" teaches that Fe-Mn alloy can be used as a material for pipe joints.

However, ferrous metal shape memory alloys are generally disadvantageous in low corrosion resistance. JP A 61-201761 discloses examples of ferrous metal shape memory alloys whose corrosion is improved by adding Cr. However, the Cr content taught is too low, i.e. not more than 10.0%, to achieve corrosion resistance well comparable with that of stainless steels. Furthermore, JP A 63-216946 teaches to improve corrosion resistance of ferrous metal shape memory alloys by adding Cr. Again, however, the Cr content taught is 10% or less and it is not taught how to realize a desired level of shape memory characteristics with the ferrous metal shape memory alloys having Cr, which is a ferrite former, in excess of 10% incorporated therein.

Further, as to general stainless steels, "Scripta Metallurgica, 1977, vol. 5, pp. 663~667" reports that SUS304 steel exhibits shape memory effect, if it is deformed at −196° C. and then heated to room temperature, however, its memory recovery is too small to put it to practical use.

OBJECT OF THE INVENTION

Accordingly, an object of the invention is to provide a pipe joint having a shape memory characteristics which can recover a memorized shape by heating to get tight junction, even though the pipe joint comprises a stainless steel including more than 10% of Cr. More particularly, an object of the invention is to provide a pipe joint of shape memory stainless steel alloy having a shape memory characteristics which joint may not recover the memorized shape at room temperature but recovers the memorized shape simply by heating it to a proper elevated temperature, and so posing no problem in workability, and which joint provides connected areas excellent in corrosion resistance, particularly crevice corrosion resistance.

DISCLOSURE OF THE INVENTION

According to the present invention, there is provided a pipe joint of stainless steel to be coaxially connected end by end to another pipe with a predetermined overlapping portion, which comprises a shape memory stainless steel alloy comprising, by weight, up to 0.10% of C, 3.0 to 6.0% of Si, 6.0 to 25.0% of Mn, up to 7.0% of Ni, more than 10.0% and not more than 17.0% of Cr, 0.02 to 0.30% of N, 2.0 to 10.0% of Co, and optionally at least one selected from 0.05 to 0.8% of Nb, 0.05 to 0.8% of V, 0.05 to 0.8% of Zr, 0.05 to 0.8% of Ti, up to 2.0% of Mo and up to 2.0% of Cu, the balance being Fe and unavoidable impurities, the alloying components being adjusted so that a D value is not less than −26.0, wherein the D value is defined by the following equation:

$$D = \mathrm{Ni} + 0.30 \times \mathrm{Mn} + 56.8 \times \mathrm{C} + 19.0 \times \mathrm{N} + 0.73 \times \mathrm{Co} + \mathrm{Cu} - 1.85 \times [\mathrm{Cr} + 1.6 \times \mathrm{Si} + 1.5 \times (\mathrm{Nb} + \mathrm{V} + \mathrm{Zr} + \mathrm{Ti}) + \mathrm{Mo}];$$

said joint being galvanized on at least its surface which will contact said another pipe in said overlapping portion;

said joint being treated at least at its end to be connected so that it may have such a shape memory effect that it will change its diameter by change in temperature.

The pipe joint according to the invention can be prepared by a method comprising:

a step of preparing a prime shaped article for the production of a pipe joint by processing a stainless steel alloy having the above-defined composition to form a pipe having a predetermined size and shape and annealing it;

a step of memorizing a primary shape by carrying out one or more times a treatment comprising deforming a diameter of a pipe end of the prime shaped article at not higher than room temperature and heating it to a temperature of at least 450° C.;

a step of galvanizing the primary shape memorized article at least at its surface which will contact with a pipe to be connected; and a step of secondarily deforming the diameter of the primary shape memorized pipe end at not higher than room temperature and putting back the temperature to room temperature to get a pipe joint having the secondarily deformed pipe end shape. The pipe joint so manufactured has such a characteristics that the primary shape of the pipe end can be recovered by heating it to a temperature of 100° to 800° C. Accordingly, with the pipe joint so prepared having such a primary shape that its inner diameter is somewhat smaller than the outer diameter of the pipe to be connected and such a secondary shape that its inner diameter is somewhat larger than the outer diameter of the pipe to be connected, a tight connection can be achieved by inserting the pipe(s) to be connected into the pipe joint in the secondarily deformed state and heating the pipe end(s) of the joint in that state to 100° to 800° C. to cause the joint to recover the primary shape. Since a galvanized layer exists in the connecting area(s), the galvanized layer may increase sealing effect in fastening pipe(s) and enhance crevice corrosion resistance of the connecting area(s).

In the aforementioned manufacturing method, the step of galvanization may be performed after the step of secondary deformation.

DESCRIPTION OF THE INVENTION

In order to achieve the objects, we have extensively studied influences of alloying components as well as mechanical working and heat treating conditions on shape memory effect of corrosion resistive Fe-Cr steels. As a result, we have found that if a Cr-Fe based metal having more than 10% of Cr is incorporated with appropriate amounts of Mn, Si and Co and the contents of C, N and Ni are properly controlled, the metal may exhibit a single austenitic phase in the annealed condition with no δ-ferritic and martensitic phases. We have also found that even if such a metal is deformed at a temperature not higher than room temperature, formation of permanent strain of work induced martensite ($\alpha'$) and dislocation can be suppressed, and in particular, when the metal is deformed at a temperature of 0° C. or lower, formation of work induced ε-phase can be facilitated and in consequence, after deformation, if the metal is heated to its As point (temperature at which ε-phase starts to transform to γ-phase) or higher, the metal exhibits excellent shape memory effect. We have further found that the shape memory effect will be remarkably enhanced by carrying out one or more times a treatment comprising deformation at a temperature of not higher than room temperature and heating at a temperature of 450° C. or higher.

Such a shape memory stainless steel has a high general corrosion resistance well comparable with other stainless steels. However, when it is used as a pipe joint, crevice corrosion may occur in connected areas where the pipe joint contact a pipe or pipes to be connected. The invention has successfully solved this problem of crevice corrosion by galvanization. Further, the galvanized layer develops a plastic flow upon shape recovery of the joint, thereby improving sealability in fastening the pipe(s).

Reasons for the restrictions of the alloying components of the stainless steel alloy used herein will now be described.

C is a strong austenite former and serves effectively to prevent the formation of a δ-ferritic phase in the annealed condition. Further C is a useful element to improve the shape memory effect. However, if C is included so much, when a cycle of deformation in the temperature range of not higher than room temperature and heating in the temperature range of not less than 450° C. is carried out one or more times (i.e. when a primary shape is memorized), Cr carbide is produced to disadvantageously deteriorate corrosion resistance and workability. For this reason the content of C must be up to 0.10%.

Since Si acts during the step of deformation to prevent the generation of permanent strain and to facilitate the formation of a work induced ε-phase, Si is indispensable to develop excellent shape memory effect in the steel alloy of the invention and not less than 3.0% thereof must be included. However, Si is a strong ferrite former, and therefore, the presence of an excessive amount of Si, not only retains so much δ-ferritic phase in the annealed condition to deteriorate the shape memory effect, but also adversely affects hot workability of the steel to make the steel making difficult. Accordingly, the upper limit for Si is now set as 6.0%.

Mn is an austenite former and serves to control the formation of a δ-ferrite phase in the annealed condition. Further since Mn acts during the step of deformation to prevent the generation of permanent strain and to facilitate the formation of a work induced ε-phase, Mn is effective to enhance shape memory effect. For these purposes at least 6.0% of Mn is required. However, if Mn is included so much, on the contrary, it restricts the formation of a work induced ε-phase to decrease the shape memory effect, and therefore, the upper limit for Mn is now set as 25.0%.

Ni is an austenite former and is useful to prevent the formation of a δ-ferrite phase in the annealed condition. However, if Ni is included so much, permanent strain may occur in the step of deformation at low a temperature to decrease the shape memory effect, and so the upper limit for Ni is now set as 7.0%.

Cr is an indispensable element for stainless steels and more than 10% of Cr is required to achieve general high corrosion resistance. Further since Cr restricts the generation of permanent strain during the step of deformation at a low temperature, Cr is effective to improve the shape memory effect. However, since Cr is a ferrite former, if it is included so much, a δ-ferrite phase is likely to remain in the annealed condition, thereby adversely affecting the shape memory effect. Accordingly, the upper limit for Cr is now set as 17.0%.

N is an austenite former and effectively acts to prevent a δ-ferrite phase from remaining in the annealed condition. Further N controls the generation of permanent strain during the step of deformation, thereby enhancing the shape memory effect. Moreover, N increases drawing strength of the pipe joint, that is resistance of the pipe joint which has fastened pipes against a force to draw the pipes out of the joint. For these effects, at least 0.02% of N is required. However, if N is included so much, blow holes are generated in an ingot prepared in the steel making process, and thus, a sound ingot cannot be obtained. Thus, the upper limit for N is now set as 0.30%.

Co is an austenite former and effectively acts to prevent a δ-ferritic phase from remaining in the annealed condition. Further Co also effectively serves to control the generation of permanent strain during the step of deformation and to facilitate the formation of a work induced ε-phase, thereby enhancing the shape memory effect. For these effects at least 2.0% of Co must be included. However, even if an increasing amount of Co is included, the effects are saturated, and so the upper limit for Co is now set as 10.0%.

Nb, V, Zr and Ti are useful elements to maintain corrosion resistance and workability of the steel, since they serve to prevent the formation of Cr carbide in the repeated cycle of deformation at not higher than room temperature and heating at an elevated temperature of 450° C. or higher. Accordingly, at least one of these elements is preferably included in an amount of at least 0.05%. However, since these elements are all ferrite formers, a δ-ferrite phase may remain in the annealed condition, and if these elements are included so much, the shape memory effect is adversely affected, and so the upper limit for the content of each element is now set as 0.8%.

Mo is effective to enhance corrosion resistance of the steel. However, since Mo is a ferrite former and if so much Mo is included, a δ-ferrite phase may remain in the annealed condition to decrease the shape memory effect and so the upper limit for Mo is now set as 2.0%.

If Cu is properly included, the corrosion resistance of the steel, particularly stress corrosion cracking resistance is improved. Further Cu is an austenite former and effectively acts to prevent a δ-ferrite phase from remaining in the annealed condition. Since these effects are not further improved by the addition of Cu in excess of 2.0%, the upper limit for Cu is now set as 2.0%.

We have experimentally found that the D value calculated according to the aforementioned equation is a measure of an amount of a δ-ferrite phase which has remained in the annealed condition and which adversely affects the shape memory effect. We have further found that if the D value is less than −26.0, so much δ-ferrite phase remains to deteriorate the shape memory effect. Accordingly, the alloying components must be mutually adjusted in order to make the D value not less than −26.0 with their individual proportions within the aforementioned respective ranges.

A method for manufacturing the pipe joint according to the invention, including conditions necessary for realizing a desired shape memory effect, will now be described.

STEP 1

First, a prime shaped article for the production of a pipe joint is prepared by processing a stainless steel alloy having the above-defined composition to form a pipe having a predetermined size and shape and annealing it. Conveniently, a steel sheet having a predetermined thickness is prepared from the stainless steel alloy having the above-defined composition by rolling at room or warm temperature, followed by annealing; and the steel sheet is made into a pipe by welding; which pipe is then fabricated to a predetermined size and shape, and annealed to provide a prime shaped article for the production of a pipe joint. The steel used herein is substantially austenitic with no δ-ferritic and martensitic phases in the annealed condition, that is in the condition as annealed and allowed to cool to room temperature.

STEP 2

The diameter of pipe end of the prime shaped article obtained in STEP 1 is deformed at not higher than room temperature and then heated to a temperature of at least 450° C. This cycle of deformation and heating is preferably repeated more than one time. The shape deformed in this step is referred to herein as "primary shape". The size of the primary shape depends upon a pipe to be connected. Desirably, the inner diameter of the pipe end of the joint is made to be somewhat smaller than the outer diameter of the pipe to be connected. Accordingly, the pipe cannot be inserted into the pipe joint having the primary shape. When the pipe joint is deformed at a low temperature, a work induced ε-phase is formed. The lower the deforming temperature is, the more amount of the work induced ε-phase can be formed. The primary shape is memorized by heating the pipe joint to 450° C. or higher and allowing it to cool to room temperature.

STEP 3

The pipe joint to which the primary shape has been memorized is galvanized. The galvanization is carried out by either hot dip coating or electrically. It is important that at least the surface which will contact the pipe to be connected is galvanized. Practically it is convenient to galvanize all the inner and outer surfaces of the pipe joint are uniformly galvanized for a sake of simpleness. Owing to this galvanization, the connected area that is the interface between the pipe and joint exhibits high crevice corrosion resistance for a long service time. The galvanized layer serves as a cushion material, thereby enhancing sealability in fastening pipes.

STEP 4

The diameter of pipe end obtained in STEP 3 to which the primary shape has been memorized and which has been galvanized, is secondarily deformed at not higher than room temperature and then warmed to room temperature. A shape of the pipe obtained in STEP 4 is referred to as "secondary shape". The inner diameter of pipe end of the joint having the secondary shape is somewhat larger than the outer diameter of the pipe to be connected. That is, in STEP 4, the inner diameter of pipe end of the joint is enlarged until it becomes somewhat larger than the outer diameter of the pipe to be connected. The formation of a work induced ε-phase is promoted by the pipe end expansion deformation at a temperature of not higher than room temperature, and the lower the deforming temperature is, the more amount of ε-phase is formed. Thus, the pipe joint obtained in STEP 4 can recover the primary shape at a high percent recovery when heated to its As point or higher.

The order of STEP 3 and STEP 4 may be reversed. That is, after the deformation to the secondary shape, the pipe joint may be galvanized. In this case, however, if the galvanizing temperature exceeds 100° C., the ε-phase formed in the secondary deformation starts to transform to a γ-phase, and thus, shape recovery to the primary shape may occur before the pipe joint is actually used in place. Accordingly, in this case, the galvanization should preferably be carried out at a temperature lower than 100° C.

The pipe joint having the secondary shape obtained by the aforementioned manufacturing method has such a shape memory characteristics that it can recover the primary shape when heated to a temperature of 100° to 800° C. and then allowed to cool to room temperature. Accordingly, when pipes are connected by means of the pipe joint according to the invention, pipes having an outer diameter whose size is intermediate between the primary and secondary shapes of the pipe joint is inserted into the joint from both the pipe ends of the joint with a predetermined overlapping portion and the overlapping portions is heated to 100° to 800° C. and allowed to cool to room temperature, whereby a tight connection can be obtained. Since the As point of the stainless steel according to the invention exists near room temperature, if the pipe is heated to a temperature higher than the As point, preferably to a temperature of at least 100° C., more preferably to a temperature of at least 200° C., the ε-phase formed by the secondary deformation transforms to a γ-phase, whereby the shape memory effect appears, and the inserted pipes are tightly fastened by the pipe joint. However, if the heating temperature exceeds 800° C., the fastening strength and, thus, the drawing strength decrease. Accordingly, the heating temperature must not exceed 800° C.

EXAMPLES

Each steel melt having a chemical composition (% by weight) indicated in Table 1 was prepared using a high frequency melting furnace. Steels A1 to A15 are steels according to the invention, that is those envisaged herein, while Steels B1 to B4 are comparative steels.

The steel melt was cast into an ingot, forged, hot rolled to a thickness of 3 mm, annealed, cold rolled to a thickness of 1 mm and annealed.

The annealed sheet was cut and formed into a pipe having an inner diameter of 22 mm by TIG welding. Then, the pipe was fabricated to a pipe of an inner diameter of 18.0 mm, which was annealed at a temperature of 1050° C. to provide a prime shaped article for the production of a pipe joint (STEP 1).

Then a cycle of pipe expand deformation wherein the inner diameter of the pipe was enlarged at a temperature of −73° C. at a rate of increase of the inner diameter of about 6% and heating at 600° C. for 15 minutes was repeated two or more times to get a final inner diameter of 19.4 mm (STEP 2).

A pipe joint was prepared from this pipe of an inner diameter of 19.4 mm via either of the following step order (1) or (2).

Order (1): the pipe joint was dipped in a molten zinc bath to provide Zn coating having a thickness of 80 μm (STEP 3), then the inner diameter of the pipe was enlarged to 20.4 mm at −73° C. (STEP 4);

Order (2): the inner diameter of the pipe joint was enlarged to 20.4 mm at −73° C. (STEP 4), then the pipe was electrically galvanized at 60° C. to provide Zn coating having a thickness of 40 μm (STEP 3).

Pipes having an outer diameter of 20.0 mm were inserted into the joint from both ends with overlapping portions of 40 mm, and the assembly so constructed was heated to 300° C., 600° C. and 1000° C. The joint and the inserted pipes were tightly joined.

Sealing, crevice corrosion resistance and drawing strength in the joined area were tested. The sealing effect was evaluated by dipping the connected pipes in water with one end closed, blowing Ar gas (pressure: 2 kg/cm$^2$) from the other open end and observing whether any gas leaked from the joined area. The crevice corrosion was tested by after dipping the connected pipes to a solution of 1000 ppm $Cl^-$ at 80° C. for 10 days, cutting out the joined portion and examining a degree of corrosion. The drawing strength was tested by pulling the connected pipes in the axial direction determine a force required to pull out the pipes from the joint.

On pipe joints according to the invention prepared from Steel Al via the above-mentioned step order (1) or (2), results of the tests wherein the heating temperature after inserting the pipes was 300° C. and 600° C. are shown in Table 2. Further results in a case wherein the heating temperature was 1000° C. and another case wherein the step of galvanization was omitted and the heating temperature was 300° C. are also shown in Table 2 as comparative examples.

As seen from Table 2, when the heating temperature was as high as 1000° C., as in comparative examples e and f, the drawing strength was low as less than 500 kg and the joint had not enough tight joining strength and sealing effect. Further, in a case wherein the pipe joint was not galvanized, as in the comparative example g, satisfactory crevice corrosion resistance, drawing strength and sealing effect were not realized, indicating that a useful pipe joint could not be obtained without galvanization. In contrast, the pipe joints of Examples a to d according to the invention had excellent drawing strength as not less than 500 kg and also exhibited good crevice corrosion resistance and sealing effect.

On pipe joints prepared from all steels shown in Table 1 via the step order (1), results of the tests wherein the heating temperature after inserting the pipes was 300° C., are shown in Table 3.

As shown in Table 3, pipe joints prepared from Steel B1 and B2 wherein Mn and Si were low, a pipe joint prepared from Steel B3 wherein no Co was included and the amount of δ-ferrite in the annealed condition was as high as 16.7%, exhibited poor shape recovery as reflected by their low drawing strength and unsatisfactory sealing effect, and therefore, these joints do not fit to shape memory pipe joint.

On the contrary, all the pipe joints prepared from A1 to A15 steel according to the invention had satisfactory crevice corrosion resistance and sealing effect and exhibited a drawing strength of at least 500 kg.

TABLE 1

| | Steel | C | Si | Mn | P | S | Ni | Cr | N | Co | Others | D value | δ (%) |
|---|---|---|---|---|---|---|---|---|---|---|---|---|---|
| A | A1 | 0.048 | 4.92 | 12.52 | 0.025 | 0.004 | 4.02 | 12.04 | 0.038 | 6.05 | — | −21.2 | 0 |
| | A2 | 0.060 | 5.17 | 12.38 | 0.024 | 0.004 | 3.95 | 12.27 | 0.042 | 3.02 | — | −23.9 | 0 |

TABLE 1-continued

| | Steel | C | Si | Mn | P | S | Ni | Cr | N | Co | Others | D value | δ (%) |
|---|---|---|---|---|---|---|---|---|---|---|---|---|---|
| | A3 | 0.041 | 4.06 | 14.93 | 0.025 | 0.005 | 3.98 | 13.15 | 0.033 | 7.01 | — | −19.8 | 0 |
| | A4 | 0.062 | 3.88 | 18.03 | 0.024 | 0.005 | 2.01 | 15.01 | 0.036 | 6.49 | — | −22.9 | 0 |
| | A5 | 0.081 | 5.16 | 17.67 | 0.024 | 0.005 | 1.97 | 12.04 | 0.040 | 6.02 | — | −20.5 | 0 |
| | A6 | 0.045 | 5.05 | 9.62 | 0.024 | 0.003 | 3.94 | 12.11 | 0.063 | 7.22 | — | −21.5 | 0 |
| | A7 | 0.058 | 4.85 | 7.76 | 0.024 | 0.004 | 5.97 | 12.05 | 0.082 | 9.00 | — | −16.9 | 0 |
| | A8 | 0.041 | 4.72 | 17.97 | 0.024 | 0.004 | 2.08 | 12.45 | 0.120 | 3.51 | — | −22.4 | 0 |
| | A9 | 0.010 | 4.08 | 21.05 | 0.025 | 0.005 | 2.07 | 12.10 | 0.204 | 3.02 | — | −19.4 | 0 |
| | A10 | 0.038 | 4.89 | 17.88 | 0.026 | 0.004 | 1.99 | 12.24 | 0.051 | 6.50 | Nb:0.38 | −23.0 | 0 |
| | A11 | 0.039 | 4.94 | 18.05 | 0.025 | 0.005 | 2.03 | 12.16 | 0.052 | 6.55 | V:0.43 | −22.9 | 0 |
| | A12 | 0.040 | 4.66 | 17.76 | 0.024 | 0.005 | 2.00 | 12.02 | 0.037 | 6.48 | Nb:0.24, Zr:0.18 | −22.2 | 0 |
| | A13 | 0.038 | 4.80 | 17.98 | 0.024 | 0.005 | 2.02 | 12.30 | 0.041 | 6.50 | V:0.32, Ti:0.14 | −23.1 | 0 |
| | A14 | 0.040 | 4.18 | 17.87 | 0.025 | 0.005 | 2.00 | 12.20 | 0.043 | 6.53 | Nb:0.24, Mo:1.05 | −22.3 | 0 |
| | A15 | 0.041 | 5.02 | 17.80 | 0.025 | 0.005 | 1.98 | 12.25 | 0.039 | 6.44 | Nb:0.35, Cu:1.21 | −22.2 | 0 |
| B | B1 | 0.035 | 5.21 | 3.95 | 0.025 | 0.004 | 2.16 | 12.16 | 0.042 | 6.89 | — | −26.8 | 1.7 |
| | B2 | 0.039 | 1.51 | 17.15 | 0.024 | 0.004 | 3.93 | 13.04 | 0.035 | 6.02 | — | −12.2 | 0 |
| | B3 | 0.033 | 5.28 | 9.30 | 0.025 | 0.005 | 3.95 | 12.21 | 0.029 | — | — | −29.1 | 16.7 |
| | B4 | 0.041 | 4.95 | 8.12 | 0.024 | 0.004 | 10.32 | 12.01 | 0.030 | 2.98 | — | −19.0 | 0 |

A: Steel according to the invention
B: Comparative steel

TABLE 2

| | Run | Order of Steps | Heating Temperature (°C.) | Crevice Corosion Resistance*1 | Drawing Strength (kg)*2 | Sealing*3 |
|---|---|---|---|---|---|---|
| A | a | (1) | 300 | o | o | o |
| | b | (2) | 300 | o | o | o |
| | c | (1) | 600 | o | o | o |
| | d | (2) | 600 | o | o | o |
| B | e | (1) | 1000 | o | x | x |
| | f | (2) | 1000 | o | x | x |
| | g | No galvanization | 300 | x | x | x |

A: Example according to the invention
B: Comparative Examples
*1Crevice Corrosion Resistance
o: No corrosion
x: Corrosion
*2Drawing Strength
o: At least 500 kg
x: Less than 500 kg
*3Sealing
o: No leakage of gas
x: Leakage of gas

TABLE 3

| | Steel | Crevice Corrosion Resistance*1 | Drawing Strength (kg)*2 | Sealing*3 |
|---|---|---|---|---|
| A | A1 | o | o | o |
| | A2 | o | o | o |
| | A3 | o | o | o |
| | A4 | o | o | o |
| | A5 | o | o | o |
| | A6 | o | o | o |
| | A7 | o | o | o |
| | A8 | o | o | o |
| | A9 | o | o | o |
| | A10 | o | o | o |
| | A11 | o | o | o |
| | A12 | o | o | o |
| | A13 | o | o | o |
| | A14 | o | o | o |
| | A15 | o | o | o |
| B | B1 | o | x | Δ |
| | B2 | o | x | x |
| | B3 | o | x | Δ |

TABLE 3-continued

| Steel | Crevice Corrosion Resistance*1 | Drawing Strength (kg)*2 | Sealing*3 |
|---|---|---|---|
| B4 | o | x | x |

A: Example according to the invention
B: Comparative Examples
*1Crevice Corrosion Resistance
o: No crevice corrosion
x: Crevice corrosion
*2Drawing Strength
o: At least 500 kg
x: Less than 500 kg
*3Sealing
o: No leakage of gas
x: Much leakage of gas
Δ: Some of gas leakage As described above, according to the invention, there is provided a pipe joint of stainless steel having good drawing strength and sealing effect by utilizing the shape memory effect. Further, the pipe joint according to the invention has not only general corrosion resistance of stainless steel but also excellent crevice corrosion resistance in the connected areas, rendering the connection highly durable. This crevice corrosion resistance is obtained by the existance of the galvanized layer, which also serves as a cushion material to improve sealability in fastening pipes. Furthermore, with the pipe joint according to the invention, pipes can be connected by heating, thus the connecting work is very simple when compared with the traditional mechanical fastening or welding. Moreover, the pipe connection obtained by means of the pipe joint according to the invention can be easily released by heating without a need of destroying the pipes. Accordingly, a useful and improved new pipe joint having corrosion resistance has now been provided by the invention.

What is claimed is:

1. A pipe joint of stainless steel to be coaxially connected end by end to another pipe with a predetermined overlapping portion, which comprises a shape memory stainless steel alloy comprising, by weight, between 0.0% and up to 0.10% of C, 3.0 to 6.0% of Si, 6.0 to 25.0% of Mn, between 0.0% and up to 7.0% of Ni, more than 10.0% and not more than 17.0% of Cr, 0.02 to 0.30% of N, 2.0 to 10.0% of Co, the balance being Fe and unavoidable impurities, the alloying components being adjusted so that a D value is not less than −26.0, wherein the D value is defined by the following equation:

$$D=Ni+0.30\times Mn+56.8\times C+19.0\times N+0.73\times Co+Cu-1.85\times(Cr+1.6\times Si);$$

said joint being galvanized on at least its surface which will contact said another pipe in said overlapping portion;

said joint being treated at least at its end to be connected so that said end has a shape memory effect, wherein a diameter of said end will change according to said shape memory effect by a change in temperature.

2. A pipe joint of stainless steel to be coaxially connected end by end to another pipe with a predetermined overlapping portion, which comprises a shape memory stainless steel alloy comprising, by weight, between 0.0% and up to 0.10% of C, 3.0 to 6.0% of Si, 6.0 to 25.0% of Mn, between 0.0% and up to 7.0% of Ni, more than 10.0% and not more than 17.0% of Cr, 0.02 to 0.30% of N, 2.0 to 10.0% of Co, and at least one selected from 0.05 to 0.8% of Nb, 0.05 to 0.8% of V, 0.05 to 0.8% of Zr, 0.05 to 0.8% of Ti, up to 2.0% of Mo and up to 2.0% of Cu, the balance being Fe and unavoidable impurities, the alloying components being adjusted so that a D value is not less than −26.0, wherein the D value is defined by the following equation:

$$D=Ni+0.30\times Mn+56.8\times C+19.0\times N+0.73\times Co+Cu-1.85\times[Cr+1.6\times Si+1.5\times(Nb+V+Zr+Ti)+Mo];$$

said joint being galvanized on at least its surface which will contact said another pipe in said overlapping portion;

said joint being treated at least at its end to be connected so that said end has a shape memory effect, wherein a diameter of said end will change according to said shape memory effected by a change in temperature.

3. A method for manufacturing a pipe joint of stainless steel excellent in crevice corrosion resistance, which comprises:

a step of preparing a prime shaped article for the production of a pipe joint by processing a stainless steel alloy to form a pipe having a predetermined size and shape and annealing it, said stainless steel alloy comprising, by weight, between 0.0% and up to 0.10% of C, 3.0 to 6.0% of Si, 6.0 to 25.0% of Mn, between 0.0% and up to 7.0% of Ni, more than 10.0% and not more than 17.0% of Cr, 0.02 to 0.30% of N, 2.0 to 10.0% of Co, and at least one selected from 0.05 to 0.8% of Nb, 0.05 to 0.08% of V, 0.05 to 0.8% of Zr, 0.05 to 0.8% of Ti, up to 2.0% of Mo and up to 2.0% of Cu, the balance being Fe and unavoidable impurities, the alloying components being adjusted so that a D value is not less than −26.0, wherein the D value is defined by the following equation:

$$D=Ni+0.30\times Mn+56.8\times C+19.0\times N+0.73\times Co+Cu-1.85\times[Cr+1.6\times Si+1.5\times(Nb+V+Zr+Ti)+Mo];$$

a step of memorizing a primary shape by subjecting the primary shape to at least one cycle comprising deforming a diameter of a pipe end of the prime shaped article at not higher than room temperature and heating it to a temperature of at least 450° C.;

a step of galvanizing the primary shape memorized article at least at its surface which will contact with a pipe to be connected; and a step of secondarily deforming the diameter of the primary shape memorized pipe end at not higher than room temperature and putting back the temperature to room temperature to get a pipe joint having the secondarily deformed pipe end shape; whereby the pipe joint so manufactured has such a characteristics that the primary shape of the pipe end can be recovered by heating it to a temperature of 100° to 800° C.

4. The method for manufacturing the pipe joint as set forth in claim 3 in which the primary shape of the pipe end of the joint is such that the inner diameter thereof is somewhat smaller than the outer diameter of the pipe to be connected and the secondary shape of the pipe end of the joint is such that the inner diameter thereof is somewhat larger than the outer diameter of the pipe to be connected.

5. A method for manufacturing a pipe joint of stainless steel excellent in crevice corrosion resistance, which comprises:

a step of preparing a prime shaped article for the production of a pipe joint by processing a stainless steel alloy to form a pipe having a predetermined size and shape and annealing it, said stainless steel alloy comprising, by weight, between 0.0% and up to 0.10% of C, 3.0 to 6.0% of Si, 6.0 to 25.0% of Mn, between 0.0% and up to 7.0% of Ni, more than 10.0% and not more than 17.0% of Cr, 0.02 to 0.30% of N, 2.0 to 10.0% of Co, and at least one selected from 0.05 to 0.8% Nb, 0.05 to 0.8% of V, 0.05 to 0.8% of Zr, 0.05 to 0.8% of Ti, up to 2.0% of Mo and up to 2.0% of Cu, the balance being Fe and unavoidable impurities, the alloying components being adjusted so that a D value is not less than 26.0, wherein the D value is defined by the following equation:

$$D=Ni+0.30\times Mn+56.8\times C19.0\times N+0.73\times Co+Cu-1.85\times[Cr+1.6\times Si+1.5\times(Nb+V+Zr+Ti)+Mo];$$

a step of memorizing a primary shape by subjecting the primary shape to at least one cycle comprising deforming a diameter of a pipe end of the prime shaped article at not higher than room temperature and heating it to a temperature of at least 450° C.;

a step of secondarily deforming the diameter of the primary shape memorized pipe end at not higher than room temperature and putting back the temperature to room temperature to get a pipe joint having the secondarily deformed pipe end shape; and a step of galvanizing the secondarily deformed article at least at its surface which will contact a pipe to be connected; whereby the pipe joint so manufactured has such a characteristics that the primary shape of the pipe end can be recovered by heating it to a temperature of 100° to 800° C.

6. The method for manufacturing the pipe joint as set forth in claim 5 in which the primary shape of the pipe end of the joint is such that the inner diameter thereof is somewhat smaller than the outer diameter of the pipe to be connected and the secondary shape of the pipe end of the joint is such that the inner diameter thereof is somewhat larger than the outer diameter of the pipe to be connected.

* * * * *